US006232858B1

(12) United States Patent
Reiter

(10) Patent No.: US 6,232,858 B1
(45) Date of Patent: May 15, 2001

(54) ELECTROMAGNETIC RELAY

(75) Inventor: Klaus Reiter, Waidhofen (DE)

(73) Assignee: EH-Schrack Components Aktiengesellschaft, Vienna (AT)

( * ) Notice: Subject to any disclaimer, the term of this patent is extended or adjusted under 35 U.S.C. 154(b) by 0 days.

(21) Appl. No.: 09/403,180

(22) PCT Filed: Mar. 31, 1998

(86) PCT No.: PCT/EP98/01854

§ 371 Date: Oct. 18, 1999

§ 102(e) Date: Oct. 18, 1999

(87) PCT Pub. No.: WO98/47163

PCT Pub. Date: Oct. 22, 1998

(30) Foreign Application Priority Data

Apr. 16, 1997 (DE) ..... 197 15 914

(51) Int. Cl.[7] ..... H01H 51/22; H01H 67/02

(52) U.S. Cl. ..... 335/80; 335/78; 335/85; 335/128

(58) Field of Search ..... 335/78, 79, 80–85, 335/86, 127, 128–131

(56) References Cited

U.S. PATENT DOCUMENTS

| | | | |
|---|---|---|---|
| 3,825,865 | 7/1974 | Prouty et al. | 335/128 |
| 4,025,884 | 5/1977 | Wright et al. | 335/129 |
| 5,070,315 | 12/1991 | Kuzukawa et al. | 335/128 |
| 5,894,254 * | 4/1999 | Reiter et al. | 335/80 |

FOREIGN PATENT DOCUMENTS

| | | |
|---|---|---|
| 1 764 256 | 3/1968 | (DE) . |
| 1 908 269 | 2/1969 | (DE) . |
| 26 17 632 | 4/1976 | (DE) . |
| 31 50 301 A1 | 12/1981 | (DE) . |
| 40 34 714 A1 | 11/1990 | (DE) . |
| 0 375398 A2 | 12/1989 | (EP) . |

* cited by examiner

*Primary Examiner*—Raymond Barrera
(74) *Attorney, Agent, or Firm*—Schiff Hardin & Waite

(57) ABSTRACT

A relay is formed by a magnet system which includes a wound coil body, an L-shaped core arranged axially therein and an, L-shaped armature as well as an insulator base from which side terminal elements project and in which stationary and movable contact elements are arranged. The actuation of the movable contact elements is carried out by way of a slide coupled to the armature. The magnet system is fastened to the base with fastening continuations which are provided at the magnet system and that engage upward projections of the base thereby firmly joining the magnet system to the base. The L-shaped armature includes a free end seated at the free end of the longitudinal leg of the L-shaped core. The fastening of the armature is carried out by a U-shaped armature spring which includes one arm secured to the longitudinal leg of the L-shaped armature and a second arm plugged into the axial recess of the coil body which also houses the longitudinal leg of the L-shaped core.

15 Claims, 3 Drawing Sheets

ELECTROMAGNETIC RELAY

FIELD OF THE INVENTION

The invention is directed to an electromagnetic relay having the following features:

a coil with coil body and winding, a L-shaped core whose longitudinal leg extends through an axial recess of the coil body and whose transverse leg lies perpendicular thereto at a first end face of the coil, a L-shaped armature that has one end seated at a first end of the core and has its other end forming a working air gap relative to the second end of the core such that core and armature approximately form a rectangle given closed working air gap, whereby a magnet system is formed by coil, core and armature, a base body of insulating material that is connected to the magnet system at that side of the coil lying opposite the armature and in which at least one stationary contact element and at least one contact spring has movable contact element cooperating therewith are contained, whereby the contact elements are respectively connected to terminal elements, and a slide that transfers the armature motion onto the at least one contact spring.

BACKGROUND OF THE INVENTION

DE 1 764 256 A1 discloses a relay of the species initially cited. This relay, however, differs from the species initially cited on the basis of the arrangement of the base body as well as of the contact and terminal elements. The arrangement therein makes a modular relay structure more difficult, clear production-oriented disadvantages deriving therefrom. Further, the base body of the relay accepting the contact elements does not exhibit any specific features for insulating the individual contact elements from one another, this being unbeneficial, particularly for multi-pole embodiments of the relay.

A goal of the invention is comprised in realizing structural preventive measures, particularly for multi-pole relays, that simplify an automated production sequence and enable a low-tolerance mounting of the magnet system at the base body as well as a precise guidance of the slide. The restoring spring and the armature as well as an improved suspension of the actuation mechanism. Particular attention is thereby paid to the modular structure of the relay. Over and above this, a compact structure is desired for multi-pole embodiments of the relay.

SUMMARY OF THE INVENTION

This goal is inventively achieved in that the base body, as an essentially flat base, is arranged parallel to the coil axis under the coil, in that the at least one contact spring extends between the coil and the base parallel to the coil axis, whereas the terminal elements are conducted toward the outside perpendicularly thereto through the base, in that the armature has its transverse leg seated at the free end of the longitudinal leg at the core, in that the longitudinal leg of the armature extends above the coil, in that the transverse leg of the core comprises a pole surface toward the top for forming the working air gap, and in that the magnet system has lateral fastening continuations in the region of the transverse core leg, said continuations engaging with upwardly applied projections of the base.

In an advantageous embodiment, the end sections of longitudinal armature leg and transverse core leg forming the working air gap are broadened T-shaped, as a result whereof the magnetic resistance in the region of the working air gap is reduced.

For designing the fastening continuations, there is the possibility, on the one hand, that the fastening continuations of the magnet system are applied to outside edges of a coil flange. Expediently, the coil flange that lies closest to the working air gap should be selected. This embodiment proves advantageous for tool-oriented reasons, since the fastening continuations can be manufactured with the required precision in a simple way.

Alternatively, there is the possibility of fashioning the fastening continuations directed downward laterally at the transverse leg of the core. In an advantageous embodiment, the fastening continuations are applied downward to the core at both sides thereof proceeding from the broadened end section thereof. Over and above this, the fastening continuations are fashioned hook-shaped in both alternatives, for example, as snap-in noses so that these can be latched to recesses applied to the continuations of the base, as a result whereof magnet system and base are connected to one another in a type of press seat. On the one hand, this leads to a stiffening of the overall system; on the other hand, no additional outlay is necessary for fastening the magnet system to the base.

Further, fastening chambers for flange continuations of the coil body are applied in the base, these comprising plug-channels for fastening winding terminal elements, so that the flange continuations are secured in the fastening chambers in the region of the armature bearing by being plugged in. Over and above this, a seating pin is fashioned at the base, this being provided with a catch nose. This catch nose is hooked to a transverse web that is applied between the bottle continuations at the coil body, so that an additional fastening of base and magnet system is realized.

The advantage of said features is comprised therein that the distance of the contacts from the working air gap is set low-tolerance in that the core or, respectively, the coil body is directly connected to the base as contact carrier. In this way, a summing-up of tolerances is avoided. The extremely low-tolerance arrangement of magnet system and base relative to one another achieves not only a precise guidance of the slide but also enables a precise definition of the excess stroke for the contact elements.

Advantageously, the actuation of the contact springs ensues via an essentially U-shaped slide coupled to the armature that has one of its lateral arms embracing the magnet system and whose middle section acts on the contact springs. Further, downwardly directed actuation elements are applied to the lower edge of the middle section. The plurality of actuation elements corresponds to the plurality of sets of contacts contained in the relay, composed of a contact spring and at least one cooperating contact element. The actuation elements can be applied in a simple way to the actuation element, which is preferably fabricated as a plastic formed part, without noteworthy added outlay. The actuation elements at the base project into contact chambers in which the sets of contacts are arranged. The individual sets of contacts are insulated from one another by the sidewalls of the contact chambers. Moreover, adequately high sidewalls of the contact chambers for the insulation of the sets of contacts can be realized in this way given a compact structure of the relay. Effective precautions for insulating the individual sets of contact in a simple way are thus integrated into the relay. Moreover, a further possibility of defining the access stroke derives due to the selection of the height of the actuation elements.

Recesses for the middle section of the slide provided in the sidewalls of the contact chambers improve the guidance thereof further. For guiding the slide, a respective pair of upwardly divided guide rails is attached to the base at both sides, this embracing an outwardly projecting guide peg applied to the outside edge of a lateral slide arm and securing this against lateral dislocation in the up and down motion of the slide.

In an advantageous embodiment of the initially cited relay, a U-shaped armature spring is provided that has a first arm secured to the longitudinal armature leg, that is arranged approximately parallel to the transverse armature leg in its middle section and that has the second arm secured parallel to the longitudinal core leg in a recess between core and coil body. The recess between core and coil body is supplied best in the form of an offset free space at the coil body. Further, the second arm of the armature spring, which is plugged into the recess between coil body and core, is preferably equipped with a catch nose that is hooked into a coining directly above in the core. As a result thereof, an unintentional dismantling of armature spring, including the armature firmly connected thereto, on the one hand, and coil body with core arranged therein, on the other hand, is not possible without further ado. For example, the catch nose is manufactured by punching from the spring sheet and subsequent bending, so that it adapts positively and non-positively to the coining located in the core. In addition, the fixing of the armature spring is improved by the seating pin integrated in the base, this serving the purpose of height positioning of the magnet system in the region of the coil terminal side.

As a result of said advantageous design features of the inventive relay, a very simple assembly sequence derives that, moreover, can be accomplished without great tool outlay or specialized work forces. The base is equipped with the contact and terminal elements, preferably simultaneously with the assembly of the magnet system. The fashioning of fastening and contact chambers, which serve as plug pockets for the components to be accepted in this context, thereby proves to be a further advantage. The armature spring is preferably previously secured to the armature. During assembly of the magnet system, the core is preferably first inserted axially into the coil body until the transverse leg of the core lies against an end face of the coil body. Subsequently, the arm of the armature spring containing the catch nose is introduced into the recess between coil body and core until the catch nose hooks firmly in the coining provided in the core. Expediently, the slide is then hooked to the armature spring tab proceeding from below, the assembly of the magnet system including the coupling of the slide being thus ended. In the last assembly step, magnet system and base are merely connected to one another with the inventive fastening elements.

Other objects and advantages of the present invention will become apparent from reading the following detailed description and appended claims, and upon reference to the accompanying drawings.

BRIEF DESCRIPTION OF THE DRAWING

The invention is explained in greater detail below with reference to exemplary embodiments on the basis of the drawing, wherein.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
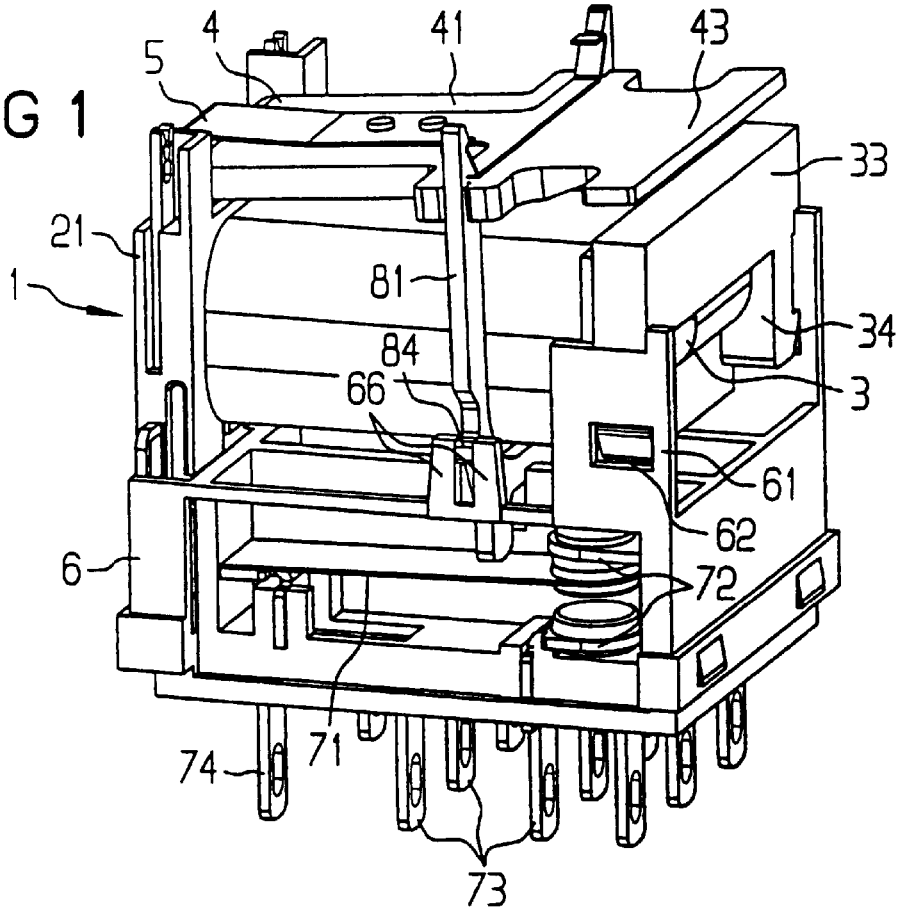
FIG. 1 illustrates an inventive relay in an embodiment with three poles shown in a perspective view.

In terms of its main components, the inventive relay is composed of a mounted magnet system 1, of a U-shaped slide 8 hooked to the armature, of a base 6, contact sets formed by contact springs and cooperating contact element 72 and winding terminal elements 74 and contact terminal elements 73 (FIG. 1). The terminal elements are conducted for the outside perpendicularly through the base 6. In order to increase the magnetic conductivity in the working air gap between yoke 33 and pole surface 43 of the armature 4, yoke 33 and pole surface 43 are implemented broadened in relationship to the armature 4 or, respectively, core 3.

Figure 2:
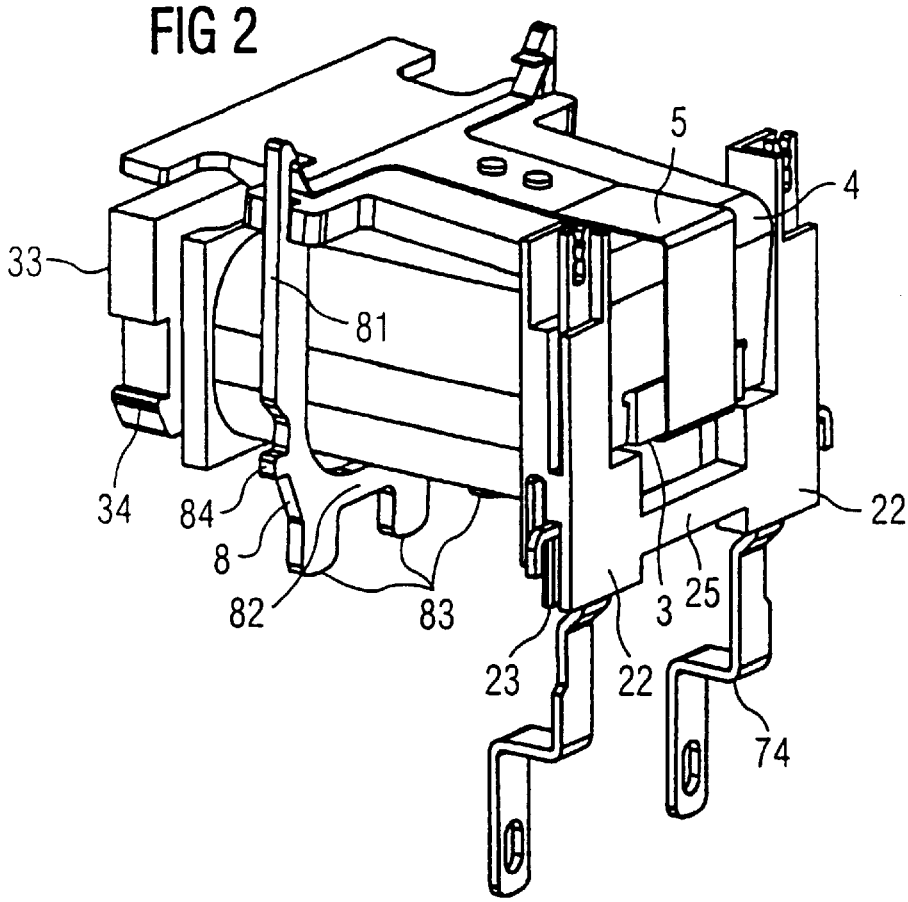
FIG. 2 illustrates a magnet system with winding terminal elements plugged in, shown in a perspective view.
Figure 3:
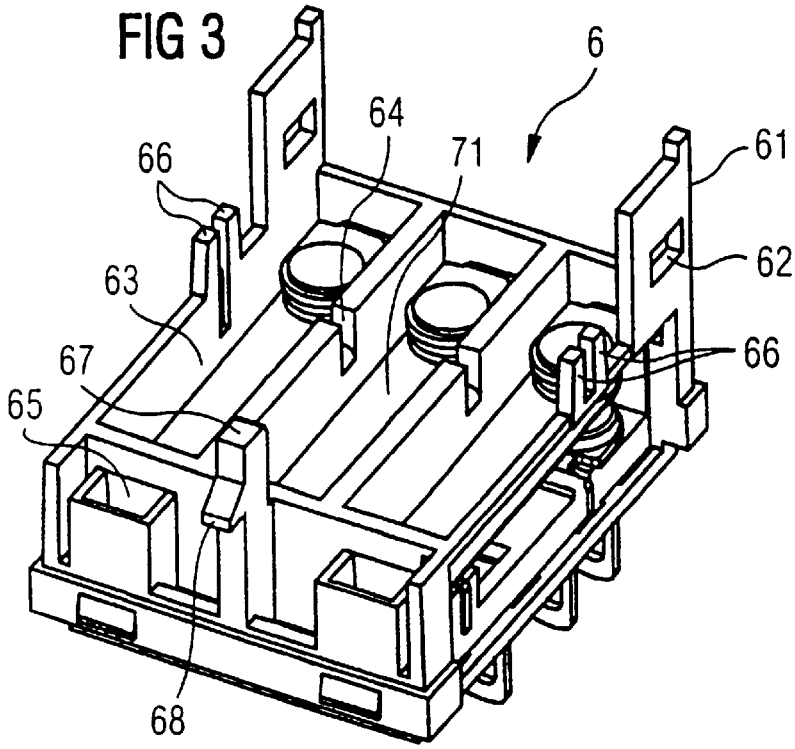
FIG. 3 illustrates a base equipped with contact sets, shown in a perspective view.
Figure 5:
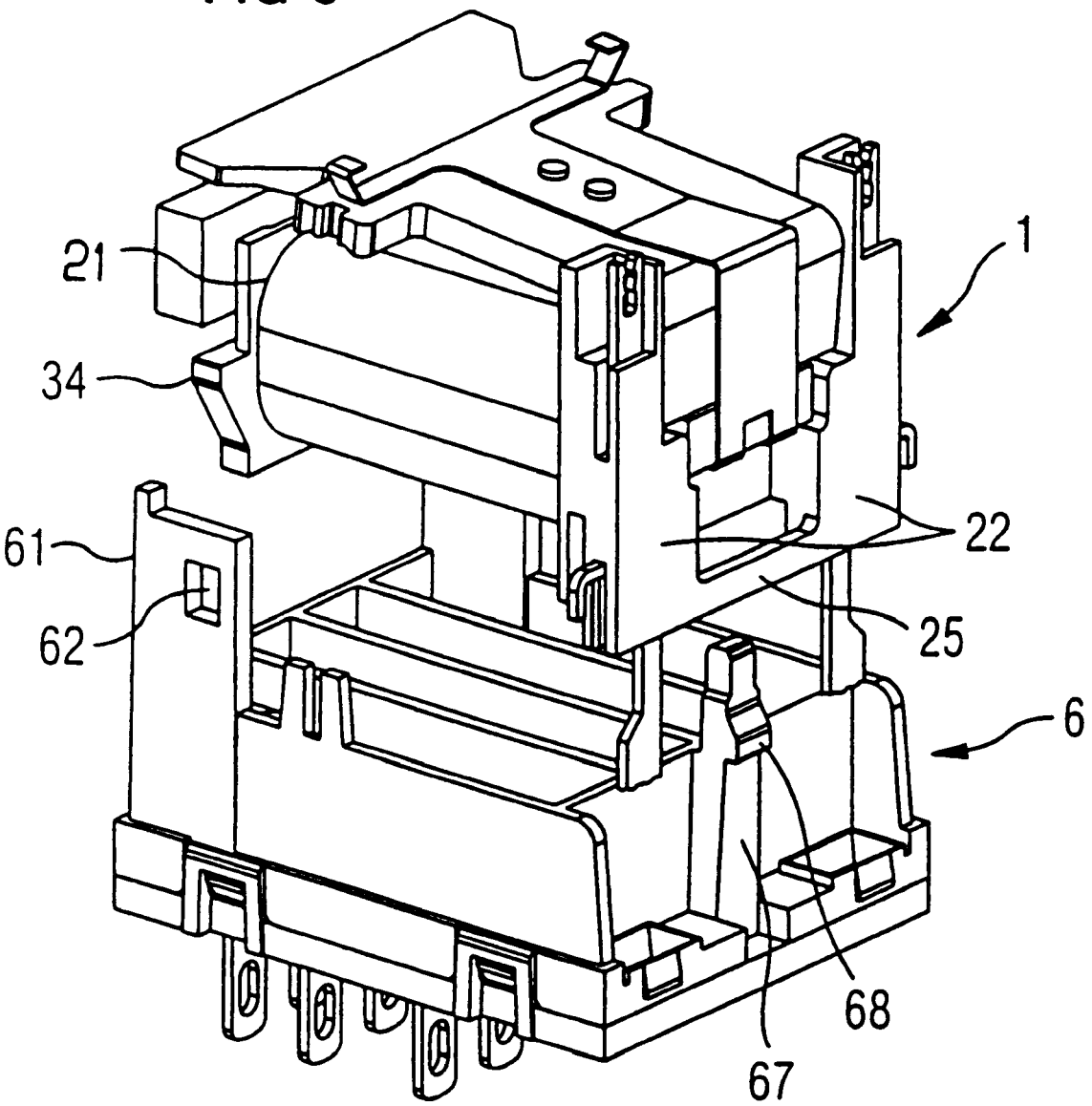
FIG. 5 illustrates an inventive relay with fastening continuations applied to the coil flange.

Fastening continuations 34 in the form of snap pegs that are hooked with recesses 62 in the base 6 (FIG. 1) are applied to the underside of the yoke 33 in the region of the broadened portion. Additionally, magnet system 1 and base 6 are connected to one another by a catch nose 68 at a seating pin 67 and a transverse web 25 between two flange continuations 22 (FIG. 2 and FIG. 3). FIG. 5 shows the alternative embodiment of the fastening continuations that, in this case, are fashioned at the outside edges of a coil flange 21 in the proximity of the working air gap.

Laterally outwardly projecting guide pegs 84 are applied to the lower end of the lateral arms 81 of the slide 8. These guide pegs are guided by guide rails 66 provided at the base 6 that laterally embrace the guide pegs in pairs and lie against them with positive fit. As a result thereof, the slide 8 is secured against lateral dislocation, particularly given the deflection armature motion onto the contact springs 71 (in this respect, also see FIG. 2 and FIG. 3). By defining the attachment height of guide peg 84 and guide rails 66, the maximum excursion of the contact springs 71 can be defined in conjunction with the specification of the depth of the gap formed by two guide rails 66, as a result whereof the access stroke for the contact springs 71 can be defined. With reference to FIG. 3, the contact chambers 63 formed in the base 6, which accept the sets of contacts composed of contact springs 71 and cooperating contact elements 72, can be seen. The individual sets of contacts of the three-pole relay are insulated from one another by the sidewalls of the contact chambers 63 that have been drawn upward. The recesses 64 let into the sidewalls of the contact chambers 73 likewise serve the purpose of an improved guidance of the slide 8 in the region of the middle section 82. Further, actuation elements 83 that project into the individual contact chambers 63 are applied to the middle section 82 of the slide 8 in order to save space (FIG. 2).

FIG. 2 also shows the fastening of the winding terminal elements 74 that have their upper end plugged into plug-in channels 23 contained in the flange continuation 22. In order to facilitate the positioning of the winding terminal elements 74 in the base 6 during assembly, the winding terminal elements 74 are crimped in the middle region. The winding terminal elements 74 have their free ends projecting perpendicularly through the base plane of the base 6.

Figure 4:
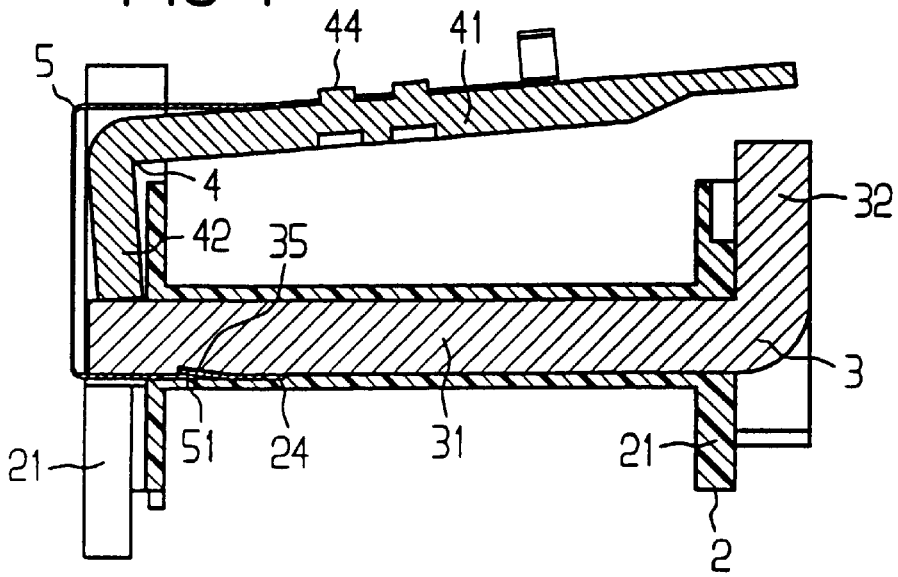
FIG. 4 illustrates a magnet system without winding shown in a longitudinal section.

FIG. 4 shows those components of the magnet system 1 that serve the purpose of fastening the armature spring 5. The flat, cuboid free space 24 can be clearly seen in the coil body 2, this accepting an arm of the armature spring 5. The arm of the armature spring 5 plugged into the free space 24 contains a catch nose 51 that is hooked into a coining 35 at the underside of the core 3. The arm of the armature spring 5 lying above the longitudinal armature leg 41 is firmly connected to the armature 4 via rivet dimples 44 attached to the longitudinal armature leg 41, so that this is prestressed by the armature spring 5 and is seated at the same time.

An extremely compact structure for a multi-pole relay results from the design possibilities disclosed here, whereby adequately dimensioned insulation elements for the individual sets of contacts are integrated into this relay embodiment. For complete encapsulation of the relay, a protective cap composed of insulating material, which is not explicitly shown here in the description of the exemplary embodiments, is inverted from above over the arrangement composed of magnet system 1 and base 6, so that the relay is encapsulated relative to the outside.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. An electronic relay comprising:

a magnet system comprising a coil assembly comprising a coil body and a winding, the coil body comprising an axial recess defining a coil axis extending between a first end and a second end;

an L-shaped core comprising a longitudinal leg that forms a first end of the core and that extends through the axial recess of the coil body with the first end of the core extending past the first end of the coil body, the L-shaped core further comprising a transverse leg that forms a second end of the core and that extends perpendicular to the longitudinal leg outside of the second end of the coil body; and an L-shaped armature comprising a transverse leg forming first end of the armature that is seated at the first end of the core, the L-shaped armature comprising a longitudinal leg that extends outside of the coil and parallel to the coil axis and that forms a second end forming a working air gap relative to the second end of the core;

the relay further comprising an insulating base body connected to the coil assembly opposite the longitudinal leg of armature, the base body being connected to at least one stationary contact element and at least one contact spring comprising a movable contact element, the stationary and movable contact elements are respectively connected to terminal elements, the base body further comprises a substantially flat base arranged parallel to the axial recess of the coil body, the at least one contact spring extends between the coil and the base and parallel to the coil axis, the terminal elements extend outward through the base and perpendicular the coil axis, the base body further comprising a plurality of upward projections;

a slide that transmits the armature motion onto the at least one contact spring; and at least one lateral fastening continuation connecting the magnet system to the upward projections of the base.

2. The relay of claim 1 wherein the second end of the core and the second end of the armature each comprise broadened T-shaped sections broadened at the working air gap.

3. The relay of claim 1 wherein the at least one fastening continuation comprises a coil flange disposed at the second end of the coil body and that extends downwards towards the upward projections.

4. The relay of claim 1 wherein the at least one fastening continuation comprises a yoke mounted on the transverse leg of the core and which comprises a plurality of downwardly projecting pegs that each engage one of the upward projections of the base.

5. The relay of claim 4 wherein the plurality of downwardly projecting pegs comprises two pegs disposed on opposing sides of the transverse leg of the core.

6. The relay of claim 1 wherein the fastening continuation comprises a plurality of downwardly extending hook-shaped projections and the upward projections of the base each comprise a recess for receiving one of the downwardly extending hook-shaped projections.

7. The relay of claim 1 wherein the first end of the coil body comprises a coil flange comprising downwardly extending flange continuations secured to the base.

8. The relay of claim 7 wherein the flange continuations comprise plug-in channels for fastening winding terminal elements.

9. The relay of claim 1 wherein the slide is a U-shaped slide with two arms disposed on opposing sides of the magnet system and a closed middle section disposed between the coil and the base, each arm being coupled to the armature, the middle section engaging the at least one contact spring.

10. The relay of claim 9 wherein the middle section of the slide comprises a plurality of downwardly applied actuation noses, each nose engaging one of the plurality of contact springs.

11. The relay of claim 9 wherein the arms of the slide each comprises outwardly projecting guide pegs for interacting with the upward projections of the base.

12. The relay of claim 1 wherein the base comprises at least two contact chambers disposed adjacent to one another, each contact chamber accommodating one contact spring and one contact element, the contact chambers being insulated from one another by insulating sidewalls.

13. The relay of claim 12 wherein the contact chambers each comprise a recess for guiding the slide.

14. The relay of claim 1 wherein the armature is seated and prestressed by a U-shaped armature spring that is secured on the longitudinal leg of the armature and that embraces the transverse leg of the armature and that is secured between the coil body and core in the axial recess and under the longitudinal core leg.

15. The relay of the claim 1 further comprising a seating pin connected to the base, and wherein the first end of the coil body comprises a flange with a downwardly extending transverse web that includes an aperture, the seating pin comprising a catch nose that is latched to the aperture of the transverse web.

* * * * *